US006506031B2

(12) United States Patent
Sishtla

(10) Patent No.: US 6,506,031 B2
(45) Date of Patent: Jan. 14, 2003

(54) SCREW COMPRESSOR WITH AXIAL THRUST BALANCING AND MOTOR COOLING DEVICE

(75) Inventor: Vishnu M. Sishtla, Cicero, NY (US)

(73) Assignee: Carrier Corporation, Syracuse, NY (US)

( * ) Notice: Subject to any disclaimer, the term of this patent is extended or adjusted under 35 U.S.C. 154(b) by 97 days.

(21) Appl. No.: 09/826,485

(22) Filed: Apr. 4, 2001

(65) Prior Publication Data

US 2002/0146332 A1 Oct. 10, 2002

(51) Int. Cl.[7] ..... F04B 17/00

(52) U.S. Cl. ..... 417/366; 417/365; 417/410.4; 418/201.1; 418/203

(58) Field of Search ..... 417/365, 366, 417/410.4; 418/201.1, 203

(56) References Cited

U.S. PATENT DOCUMENTS 4,915,514 A * 4/1990 Soderlund ..... 384/616
5,135,374 A * 8/1992 Yoshimura et al. ..... 418/201.2
5,281,115 A * 1/1994 Timuska ..... 418/9
5,411,388 A * 5/1995 Soderlund ..... 418/203
5,678,987 A * 10/1997 Timuska ..... 418/97
5,807,091 A 9/1998 Shaw
6,050,797 A * 4/2000 Zhong ..... 418/203
6,093,007 A 7/2000 Shaw
6,059,551 A * 9/2000 Amano et al. ..... 418/84
6,186,758 B1 * 2/2001 Shaw ..... 418/203

* cited by examiner

*Primary Examiner*—Charles G. Freay
*Assistant Examiner*—William Rodriguez
(74) *Attorney, Agent, or Firm*—Bachman & LaPointe, P.C.

(57) ABSTRACT

A screw compressor having balanced axial thrust includes a housing having a fluid inlet and a fluid outlet; a rotor disposed in the housing for receiving low pressure fluid from the inlet and discharging increased pressure fluid from the outlet, the rotor having a discharge end and a motor end; a balance piston arranged to exert a balancing force on the motor end of the rotor; and a conduit for conveying a high pressure fluid to the balance piston so as to exert the balancing force.

8 Claims, 1 Drawing Sheet

SCREW COMPRESSOR WITH AXIAL THRUST BALANCING AND MOTOR COOLING DEVICE

BACKGROUND OF THE INVENTION

The invention relates to screw compressors and, more particularly, to screw compressors used in water cooled chillers and the like and balancing of axial thrust in same.

Screw compressors used in water cooled chillers are typically of the oil flooded type. Axial thrust in this type of device is considerably high, typically resulting in the need for multiple bearings to carry the load.

If this thrust is not balanced or otherwise reduced, bearings and other compressor components can rapidly wear, causing the need for frequent repair.

Balancing pistons have been devised for balancing this thrust, but are positioned at the discharge end of the screw and tend to block the discharge porting of the male rotor of the compressor. Blockage of the discharge or exit port can be in the range of approximately 15% with such devices, and can result in substantial pressure losses. In addition, liquid trapping can result.

It is clear that the need remains for an apparatus for satisfactorily balancing axial thrust of screw compressors for water cooled chillers and the like.

It is therefore the primary object of the present invention to provide a screw compressor having an axial thrust balancing device.

It is a further object of the present invention to provide such a screw compressor which further includes a motor cooling apparatus.

Other objects and advantages of the present invention will appear hereinbelow.

SUMMARY OF THE INVENTION

In accordance with the present invention, the foregoing objects and advantages have been readily attained.

In accordance with the present invention, a screw compressor having balanced axial thrust is provided which comprises a housing having a fluid inlet and a fluid outlet; a rotor disposed in said housing for receiving low pressure fluid from said inlet and discharging increased pressure fluid from said outlet, said rotor having a discharge end and a motor end; a balance piston arranged to exert a balancing force on said motor end of said rotor; and a conduit for conveying a high pressure fluid to said balance piston so as to exert said balancing force.

In accordance with preferred aspects of the present invention, the balance piston can be provided as a portion of the motor rotor end ring.

In accordance with a further preferred aspect of the present invention, an end cover for the screw compressor is provided which is adapted for conveying high pressure fluid to the balance piston, and may also be adapted for conveying cooling fluid to the motor.

BRIEF DESCRIPTION OF THE DRAWINGS

A detailed description of preferred embodiments of the present invention follows, with reference to the attached drawings, wherein.

DETAILED DESCRIPTION

Figure 1:
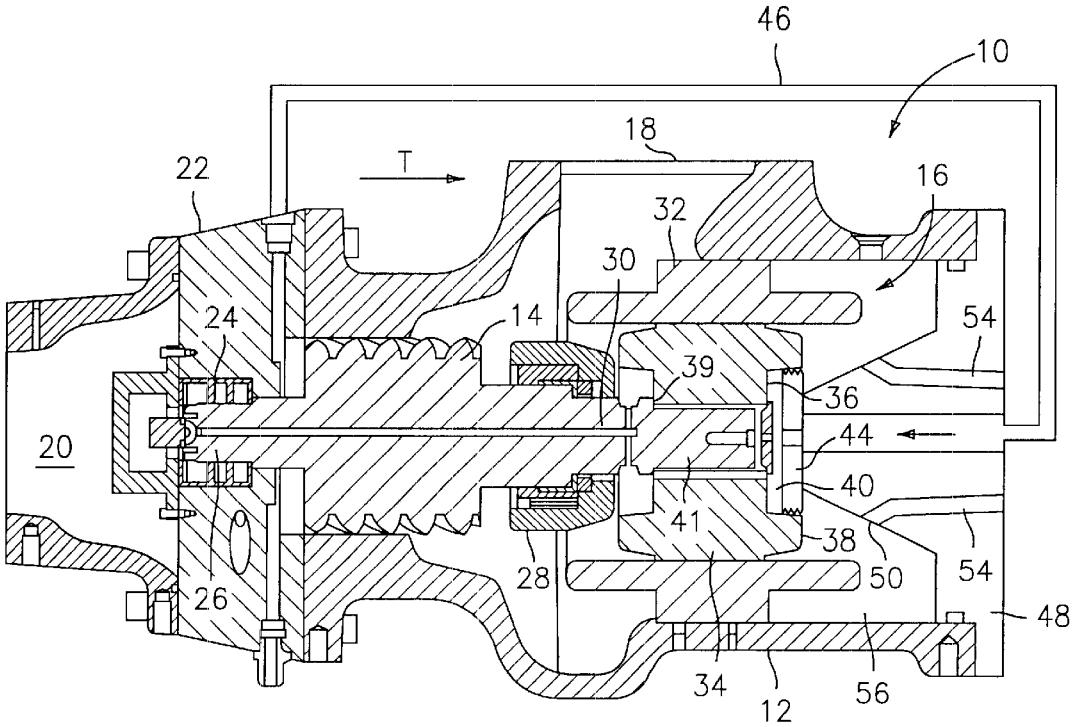
FIG. 1 is a side sectional view of a screw compressor in accordance with the present invention.

FIG. 1 shows a screw compressor 10 in accordance with the present invention which includes a compressor housing 12 for rotatably receiving a rotor 14 as well as a motor 16 for driving rotor 14. Housing 12 has an inlet 18 for medium to be compressed, and an outlet or discharge end 20 for discharging compressed medium.

A discharge manifold assembly 22 is mounted to one end of housing 12 and includes a bearing structure 24 for rotatably receiving one end 26 of rotor 14. The structure of discharge manifold assembly 22 is well known to a person of ordinary skill in the art.

Housing 12 also includes a motor-end bearing assembly 28 disposed for rotatably receiving a motor-side end 30 of rotor 14.

Also as shown in FIG. 1, motor 16 typically includes a stator 32 fixedly mounted within housing 12 and a rotor 34 adapted to be driven by stator 32 and engaging motor-side end 30 of rotor 14 for driving same.

It should be readily apparent that operation of such an assembly results in a substantial thrust force on rotor 14 which is illustrated in FIG. 1 at arrow T.

In accordance with the present invention, this thrust T is advantageously balanced so as to reduce wear on the bearings and other components of compressor 10.

In accordance with the invention, it has been found that a balancing piston can advantageously be used to balance thrust, and that such balancing piston can be positioned toward the motor end of rotor 14 so as to avoid blocking any discharge flow areas and thereby interfering with proper operation of screw compressor 10. In accordance with the invention, a balancing force is applied to a balancing piston surface disposed on the motor rotor, and a high pressure fluid is exposed to the balancing piston so as to appropriately balance the thrust generated by operation of the compressor.

FIG. 1 shows rotor 14 having a surface 36 which is sized and used as a balance piston. Surface 36 can be machined out of conventional motor rotors 34, to provide a suitable area to which fluid under pressure can be exposed to generate the desired balancing force. As shown in FIG. 1, in accordance with this embodiment of the invention, rotor 34 preferably has an end ring 38 extending beyond surface 36, which can be machined away or otherwise treated so as to provide surface 36 having the desired size. According to the invention, a chamber 40 is defined for receiving high pressure fluid between surface 36, and inner cylindrical wall 42 of ring 38, and a seal member 44 which is discussed further below. In this embodiment, high pressure fluid is delivered through a conduit 46 and into chamber 40 so as to exert the desired force on surface 36 and balance thrust T as desired.

In this embodiment, housing 12 is provided having an end cover member 48 fixed to housing 12 and having an inwardly protruding structure 50 on which is mounted seal member 44 for proper positioning with a radial edge 52 of seal member 44 substantially sealingly engaged with inner cylindrical wall 42 of end ring 38. In this embodiment, conduit 46 advantageously passes through end cover 48 and seal member 44 as shown so as to introduce high pressure fluid into chamber 40 as desired.

End cover 48 is also preferably provided having cooling medium conduits 54 which are adapted to receive cooling-medium, preferably from the condenser (not shown) and for spraying such cooling medium onto motor 16 for desired cooling. Cooling medium 54 is preferably introduced into housing 12 into a cooling chamber 56 which is defined between an inner wall of housing 12, end cover 48, ring 38, motor stator 32 and a back surface of seal member 44. The structure and positioning of end cover 48 and seal member 44 advantageously serves to separate cooling chamber 56 from high pressure fluid chamber 40 such that cooling medium does not interfere with the function of high pressure fluid in chamber 40. Housing 12 is also preferably provided with a drain from cooling chamber 56 for draining cooling medium back to the condenser.

In accordance with the present invention, high pressure medium to be introduced through conduit 46 into chamber 40 may suitably be taken from high pressure compressor medium at the discharge end of rotor 14, for example as shown in FIG. 1.

This is particularly advantageous since the fluid will be under substantially the same pressure as the fluid exerting the thrust, and further since such fluid is generated at a substantially constant pressure and will not result in pulsations of balancing force, which would be undesirable. Of course, high pressure fluid can be provided from other sources as well, for example from the condenser. However, fluid from the condenser would be provided at a reduced pressure as compared to compressor discharge pressure, and may require a larger balance piston.

Figure 2:
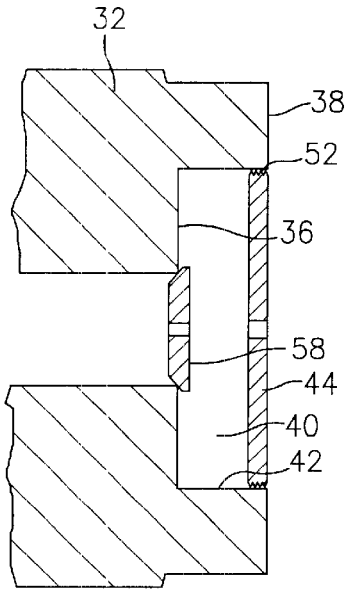
FIG. 2 is an exploded view of a portion of the compressor of FIG. 1.

FIG. 2 shows an exploded portion of the embodiment of FIG. 1 illustrating the portions of screw compressor 10 which define chamber 40 for high pressure fluid. As shown, motor rotor 34 has surface 36 and end ring 38 partially defining chamber 40, while seal member 44, in this embodiment a labyrinth seal or labyseal, defines a further portion of the walls of chamber 40. A plate 58 holds rotor 38 against a step 39 on shaft 41 and is preferably disposed over the shaft opening of motor 34. Plate 58 may be secured to shaft 41 using any conventional means. In accordance with the invention, a labyrinth seal is particularly preferred for seal member 44, since a labyrinth seal is provided having a series of flexible extending ridges that allow for only a minimal amount of leakage from high pressure chamber 40 into the motor cavity or chamber 56.

In accordance with the present invention, it should be readily apparent that the thrust balancing system of the present invention can be adapted or incorporated into many existing compressors without substantial modification of same. For example, conventional motor rotors can be machined within the end ring to provide a surface 36 having desirable area for appropriate balancing of thrust T. With a known pressure of fluid to be applied, and a known amount of thrust to be expected, the amount of area to be machined into surface 36 can readily be determined. In this regard, it is not desired to completely overcome the positive thrust T. Some thrust T is desired so as to keep the compressor operating in a stable manner. It is not desirable to have the male rotor 14 be floating between bearings. However, by minimizing the positive thrust, the load on bearings is decreased and their useful life is therefore increased.

Seal member 44 in accordance with the present invention can be either an aluminum or electrically insulated material, particularly if there are issues related to potential electric arcing across the end ring and labyrinth seal.

Conduit 46 for conveying high pressure fluid can be an external conduit as shown, or could alternatively be an internal conduit, for example within housing 12.

In accordance with the foregoing, it should be appreciated that a screw compressor has been provided which includes a thrust balancing configuration and cooling configuration that advantageously provide for the desired benefits in accordance with present invention.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A screw compressor having balanced axial thrust, comprising:

a housing having a fluid inlet and a fluid outlet;

a rotor disposed in said housing for receiving low pressure fluid from said inlet and discharging increased pressure fluid from said outlet, said rotor having a discharge end and a motor end;

a balance piston arranged to exert a balancing force on said motor end of said rotor; and a conduit for conveying a high pressure fluid to said balance piston so as to exert said balancing force.

2. The apparatus of claim 1, further comprising a motor in said housing for driving said rotor, said motor having a motor rotor coupled to said motor end of said rotor, said balance piston being disposed on said motor rotor.

3. The apparatus of claim 2, wherein said balance piston is sized to balance thrust from said increased pressure fluid on said discharge end of said rotor.

4. The apparatus of claim 2, further comprising a seal member disposed relative to said balance piston so as to define a balance fluid chamber, and wherein said conduit conveys said high pressure fluid to said chamber.

5. The apparatus of claim 4, wherein said motor rotor has an end ring extending beyond said balance piston and defining an inwardly facing cylindrical wall, wherein said seal member has a radial edge, and wherein said seal member is positioned with said radial edge substantially sealingly disposed relative to said inwardly facing cylindrical wall.

6. The apparatus of claim 4, wherein said housing has a first end connected to a discharge manifold and a second end, and further comprising an end cover connected to said second end, said seal member being mounted to said end cover.

7. The apparatus of claim 6, wherein said conduit passes through said end cover and said seal member.

8. The apparatus of claim 7, further comprising cooling fluid conduits positioned in said end cover for conveying cooling fluid to said motor.

* * * * *